US005626344A

United States Patent [19]

Huang

[11] Patent Number: 5,626,344

[45] Date of Patent: May 6, 1997

[54] DOUBLE BULL'S-EYE DEVICE

[76] Inventor: Chun-Mu Huang, 6F, No. 60-5, Cheng I S. Rd., Sanchung City, Taipei Hsien, Taiwan

[21] Appl. No.: 500,008

[22] Filed: Jul. 10, 1995

[51] Int. Cl.[6] ..... F41J 3/00

[52] U.S. Cl. ..... 273/376

[58] Field of Search ..... 273/403, 408, 273/404, 371, 374, 376

[56] References Cited

U.S. PATENT DOCUMENTS 4,586,716 5/1986 Brejcha et al. ..... 273/376
5,193,817 3/1993 Pan ..... 273/376
5,417,437 5/1995 Coppard et al. ..... 273/403
5,482,291 1/1996 Houriet, Jr. et al. ..... 273/376

FOREIGN PATENT DOCUMENTS 192984 10/1992 Taiwan ..... G09G 5/16

*Primary Examiner*—William H. Grieb
*Attorney, Agent, or Firm*—Beveridge, DeGrandi, Weilacher & Young, LLP

[57] ABSTRACT

A double bull's-eye device incorporated within a circular rib formed on a dart frame includes a base having a top end and a bottom end engagable with the circular rib, an outer bull's-eye sleeved from the top end on the base, and an inner bull's-eye passing from the top end through the base to be mounted on the base. Such double bull's-eye device can be incorporated to the dart frame easily.

20 Claims, 6 Drawing Sheets

DOUBLE BULL'S-EYE DEVICE

FIELD OF THE INVENTION

The present invention relates to a double bull's-eye device, and more particularly to a double bull's-eye device incorporated within a dart game without any securing part.

BACKGROUND OF THE INVENTION

A dart game is an interesting exercise equipment which has a dart panel including a bull's-eye and many concentric annular regions and radially divided into many sectorial blocks each of which is related to a specific score.

Early dart games or devices had only one bull's-eye. Afterwards, people developed a dart device having double bull's-eyes by defining a smaller region inside the original bull's-eye so as to make two concentric circular regions; generally, the inner bull's-eye's score is higher than the outer bull's-eye's in order to challenge the player's darting accuracy and to advance the interest of the game.

Relative references found about double bull's-eye device include R.O.C. Utility Model No. 192,984, U.S. Pat. Nos. 4,586,716 and 5,193,817. The U.S. Pat. No. 4,586,716 disclosed a double bull's-eye device formed by engaging an ax/al key way provided on the outer bull's-eye and an extension provided on the rib of the inner bull's-eye. The R.O.C. Utility Model No. 192,984 and the U.S. Pat. No. 5,193,817 correspondingly disclosed a similar double bull's-eye device which is formed by sleeving an inner circular target plate onto an annular support member sleeved onto an outer circular target plate and then securing the annular support member on a target frame with screws; but, such a dart device would have a higher cost due to the tedious assembly with screws.

References:

1. R.O.C. Utility Model No. 192,984 issued to Pan, Jong-Haw on Oct. 11,1992.
2. U.S. Pat. No. 4,586,716 issued to Brejcha et al. on May 6, 1986.
3. U.S. Pat. No. 5,193,817 issued to Pan on Mar. 16, 1993.

SUMMARY OF THE INVENTION

The object of the present invention is to provide a double bull's-eye device capable of being incorporated within a dart game or device without any securing part.

In accordance with the present invention, a double bull's-eye device adapted to be incorporated within a circular rib formed on a dart frame comprises a base having a top end and a bottom end engagable with the circular rib, an outer bull's-eye sleeved from the top end on the base; and an inner bull's-eye passing from the top end through the base to be mounted on the base.

In accordance with the present invention, the base is a tubular member provided with at least one inner axial groove and at least one inner circumferential indentation, and including an intermediate shoulder and a bottom flange having a plurality of projecting parts which respectively have a plurality of through holes.

In accordance with the present invention, the bottom flange has three projecting parts.

In accordance with the present invention, the base has two inner axial grooves and two inner circumferential indentations.

In accordance with the present invention, the outer bull's-eye has an annular wall having a plurality of axial indentations for respectively receiving therein the plurality of projecting parts and a plurality of feet for respectively passing through the plurality of through holes.

In accordance with the present invention, the circular rib has a plurality of indentations for respectively engaging with the plurality of axial projecting parts.

In accordance with the present invention, the inner bull's-eye further includes a hollow cylinder having a top end and at least one bottom projection for being inserted along the at least one inner axial groove and then to be retained respectively in the at least one inner circumferential indentation; and a ring provided on the top end of the hollow cylinder and protruding above the outer bull's-eye.

The present invention may best be understood through the following description with reference to the accompanying drawings, in which:

DETAILED DESCRIPTION OF THE PREFERRED EMBODIMENT

Figure 1:
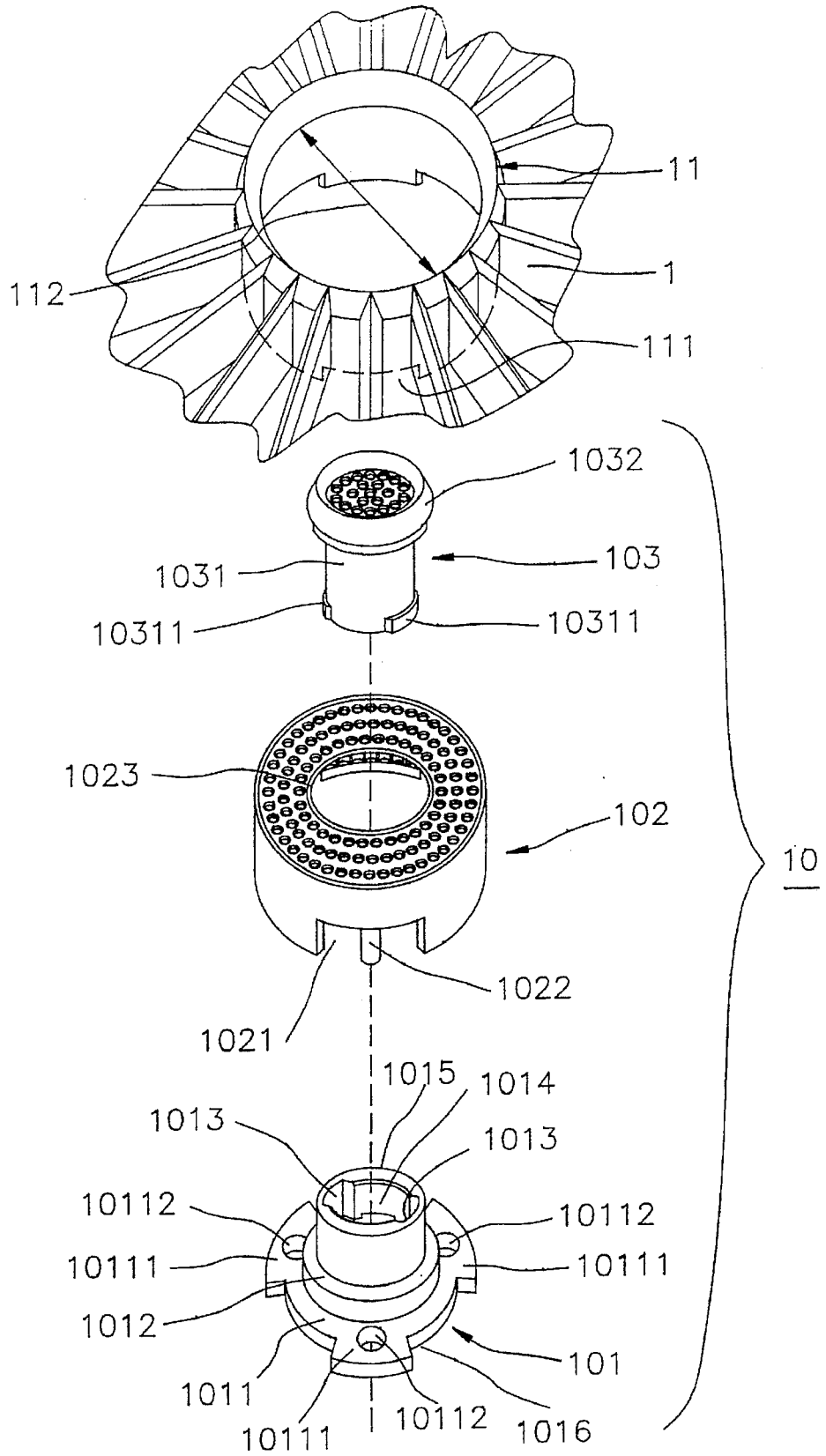
FIG. 1 is a perspective view showing the disassembled parts of a double bull's-eye device according to the present invention.

Referring to FIG. 1, the present double bull's-eye device 10 is adapted to be incorporated within a circular rib 11 formed on a dart frame 1, which includes a base 101 having a top end 1015 and a bottom end 1016 for being engagable with the circular rib 11, an outer bull's-eye 102 sleeved from the top end 1015 on the base 101 and an inner bull's-eye 103 passing from the top end 1015 through the base 101 to be mounted on the base 101.

The base 101 is a tubular member provided with two inner axial grooves 1013, two inner circumferential indentations 1014, an intermediate shoulder 1012 and a bottom flange 1011 having three projecting parts 10111 each of which has one through hole 10112. The outer bull's-eye 102 has an annular wall having three axial indentations 1021 for respectively receiving therein the three projecting parts 10111 and three feet 1022 for respectively passing through the three through holes 10112. The circular rib 11 has three indentations 111 for respectively engaging with the three radial projecting parts 10111. The inner bull's-eye 103 includes a hollow cylinder 1031 having a top end, two bottom projections 10311 for being inserted along the two inner axial grooves 1013 and then retained respectively in the two inner circumferential indentations 1014 and a ring 1032 provided on the top end of the hollow cylinder 1031 and protruding above the outer bull's-eye 102.

Figure 2A:
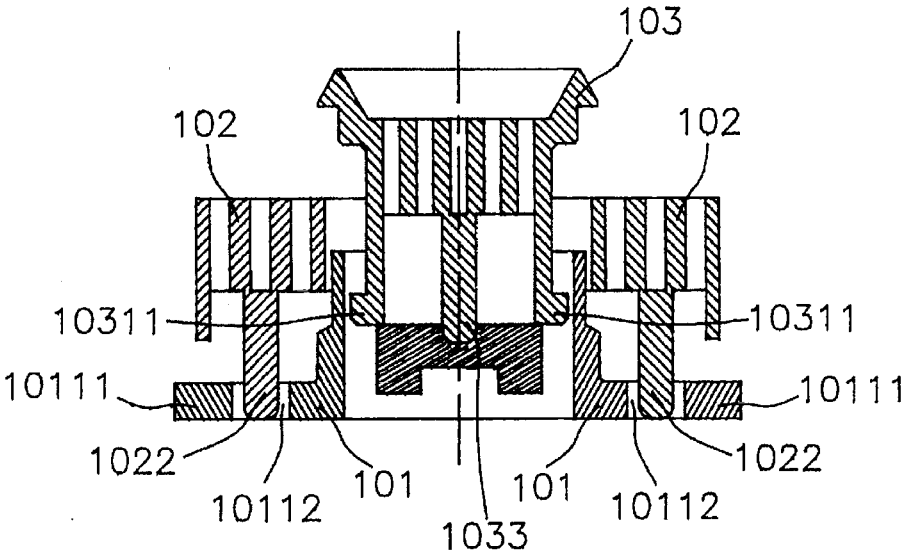
FIGS. 2A and 2B are sectional views schematically showing a process of assembling the inner bull's-eye of a double bull's-eye device according to the present invention.
Figure 2B:
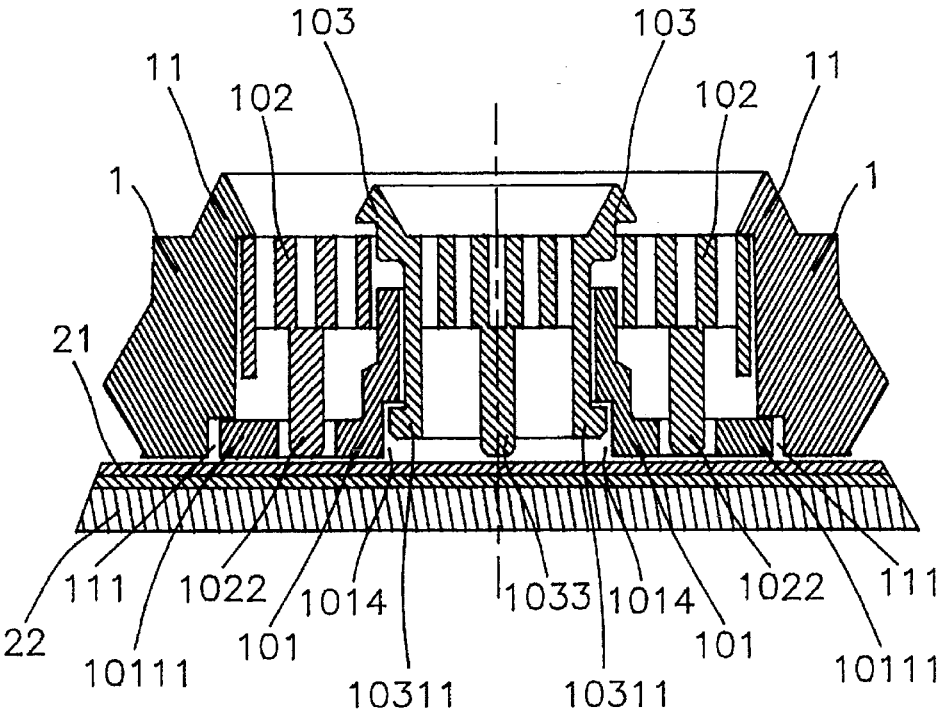

To assemble the present double bull's-eye device 10, one will sleeve the outer bull's eye 102 onto the base 101, respectively engage the three axial indentations 1021 (shown in FIG. 1) with the three projecting parts 10111, then respectively pass the three feet 1022 of the outer bull's eye 102 through the three holes 10112 of the base 101 (shown in FIG. 2A), and finally mount the inner bull's-eye 103 on the circular tube of the base 101 by rotating the two bottom projections 10311 to engage with the two inner circumferential indentations 1014 of the base 101 (shown in FIG. 2B). The assembled double bull's-eye device 10 is incorporated in a circular rib 11 having three indentations 111 for respectively engaging with the three radial projecting parts 10111 so as to prevent the base 101 from turning.

Figure 3A:
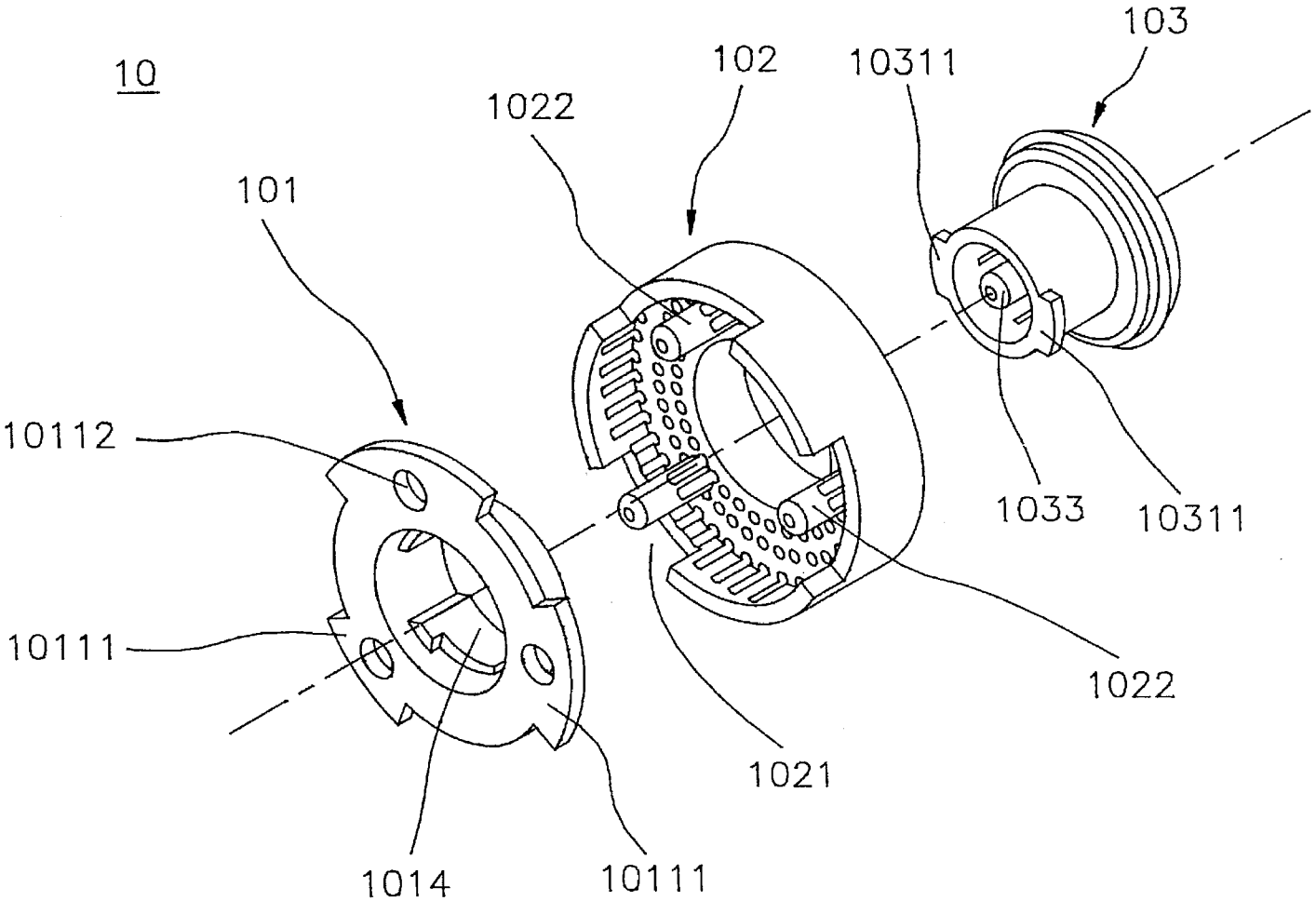
FIGS. 3A, 3B and 3C are perspective views schematically showing a process of assembling a double bull's-eye device according to the present invention.
Figure 3B:
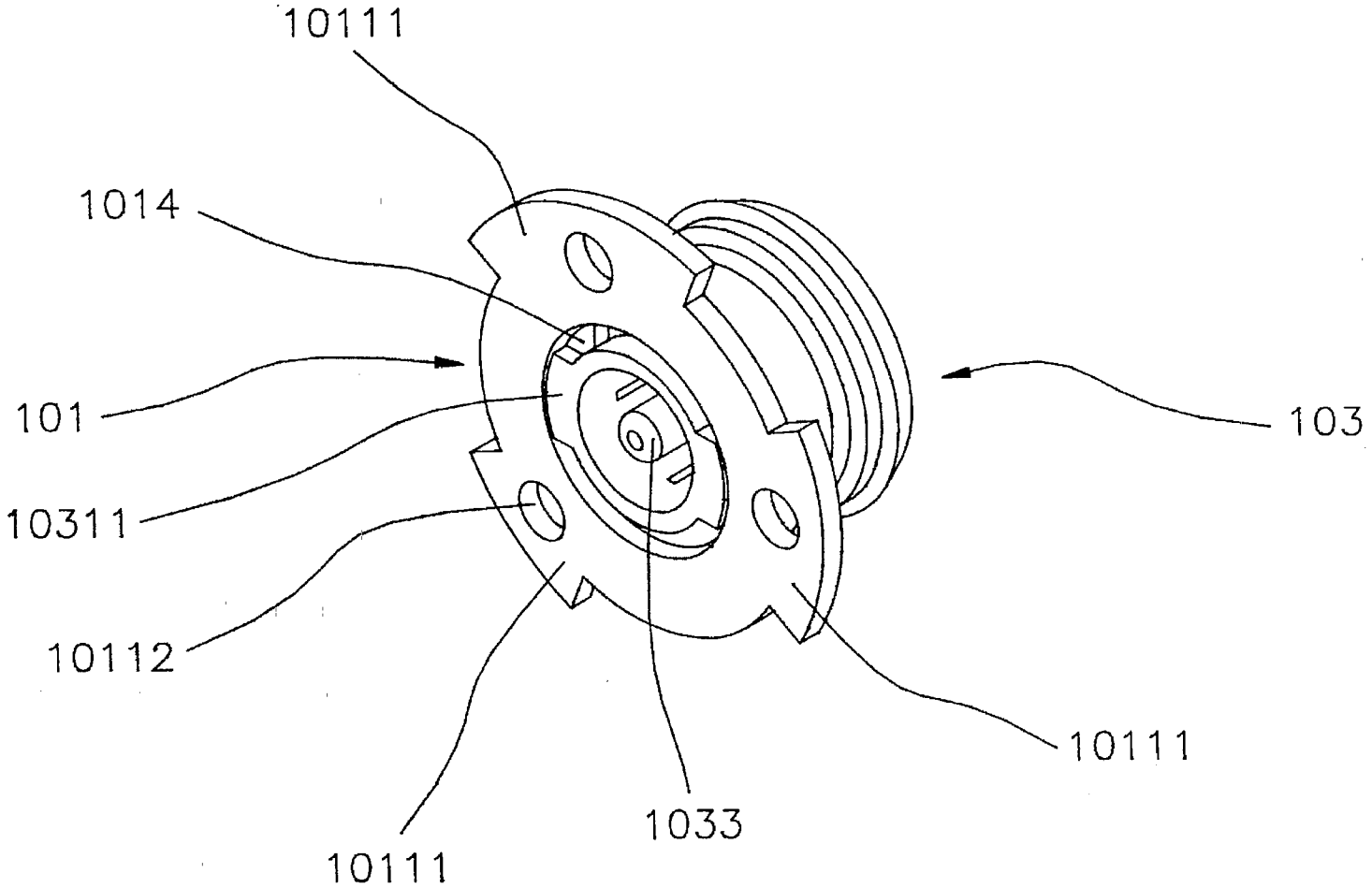
Figure 3C:
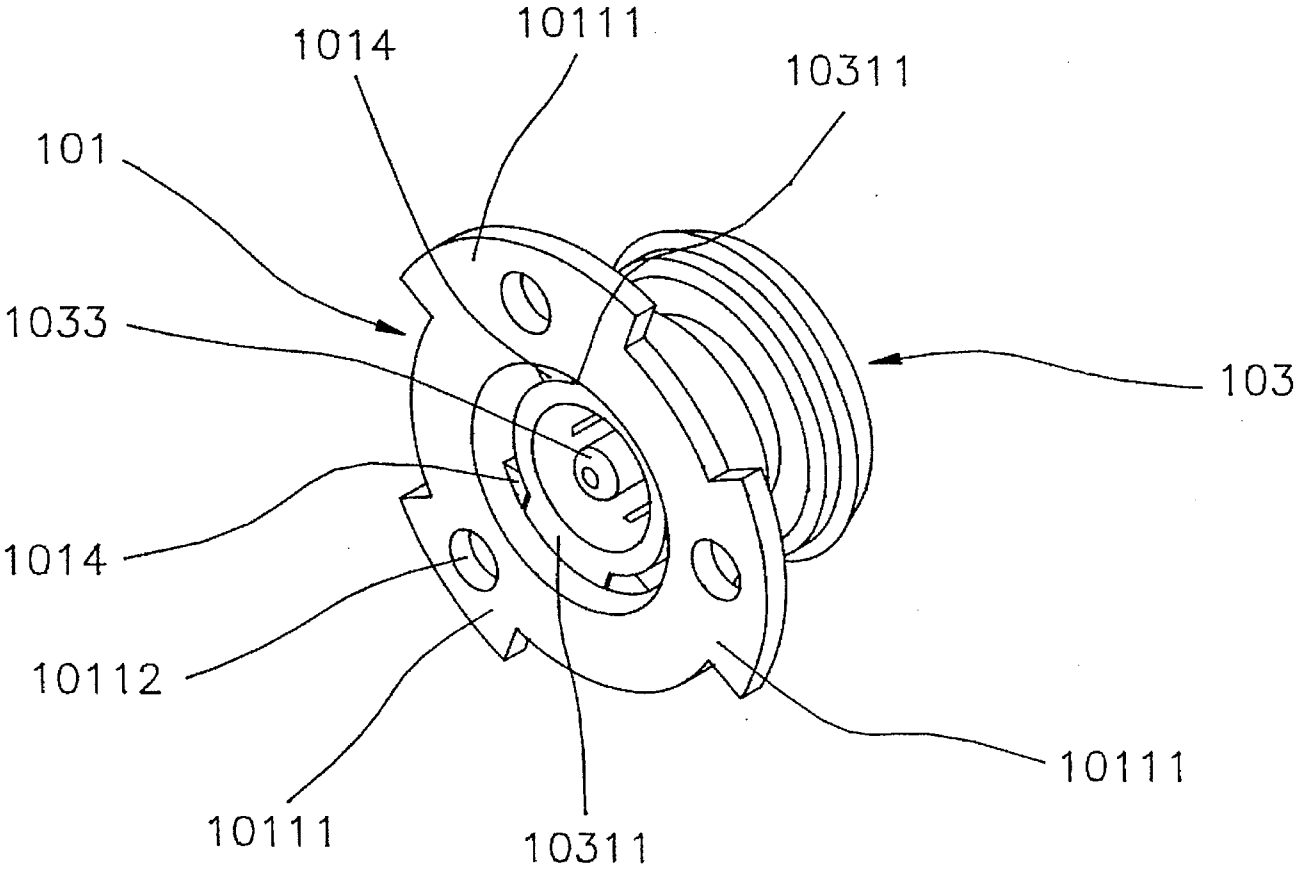

Referring to FIGS. 2A and 2B, the dart device according to the present invention includes a dart frame 1 having a circular rib 11, a base 101, an outer bull's-eye 102, an inner bull's-eye 103, a conducting matrix device 21 and a bottom cover 22. After the double bull's-eye device is assembled in the dart device, the inner bull's-eye 103 cannot be disengaged. Also, referring to FIGS. 3A, 3B and 3C, if the inner bull's-eye 103 is to be taken out, then one will have to press the inner bull's-eye 103 in the direction toward the conducting matrix device 21 and then rotate the inner bull's eye 103 in order to disengage the two bottom projections 10311 from the two inner circumferential indentations 1014 of the base 101; but due to the fact that the assembled double bull's-eye device 10 is stopped by the conducting matrix device 21 which is supported by the bottom cover 22, the inner bull's-eye 103 has no space to be pressed down and accordingly cannot be disengaged. As a result, when the outer bull's-eye 102 is darted, then it will axially move a distance to contact the conducting matrix device 21 with its feet 1022 so as to generate a signal; while when the inner bull's-eye 103 is darted, then the inner bull's-eye 103 will axially move a distance to contact the conducting matrix device 21 with the foot 1033 of the inner bull's-eye 103 so as to generate a signal.

Preferably, the diameter 112 (shown in FIG. 1 ) of the outer bull's-eye 102 is larger than that of the circular rib 11 and the inner bull's-eye 103 is retained in the base 101 by its bottom projections 10311 so as to ensure that the double bull's-eye device is secured in the dart frame 1 when the dart is to be pulled out of the dart frame 1.

Figure 4:
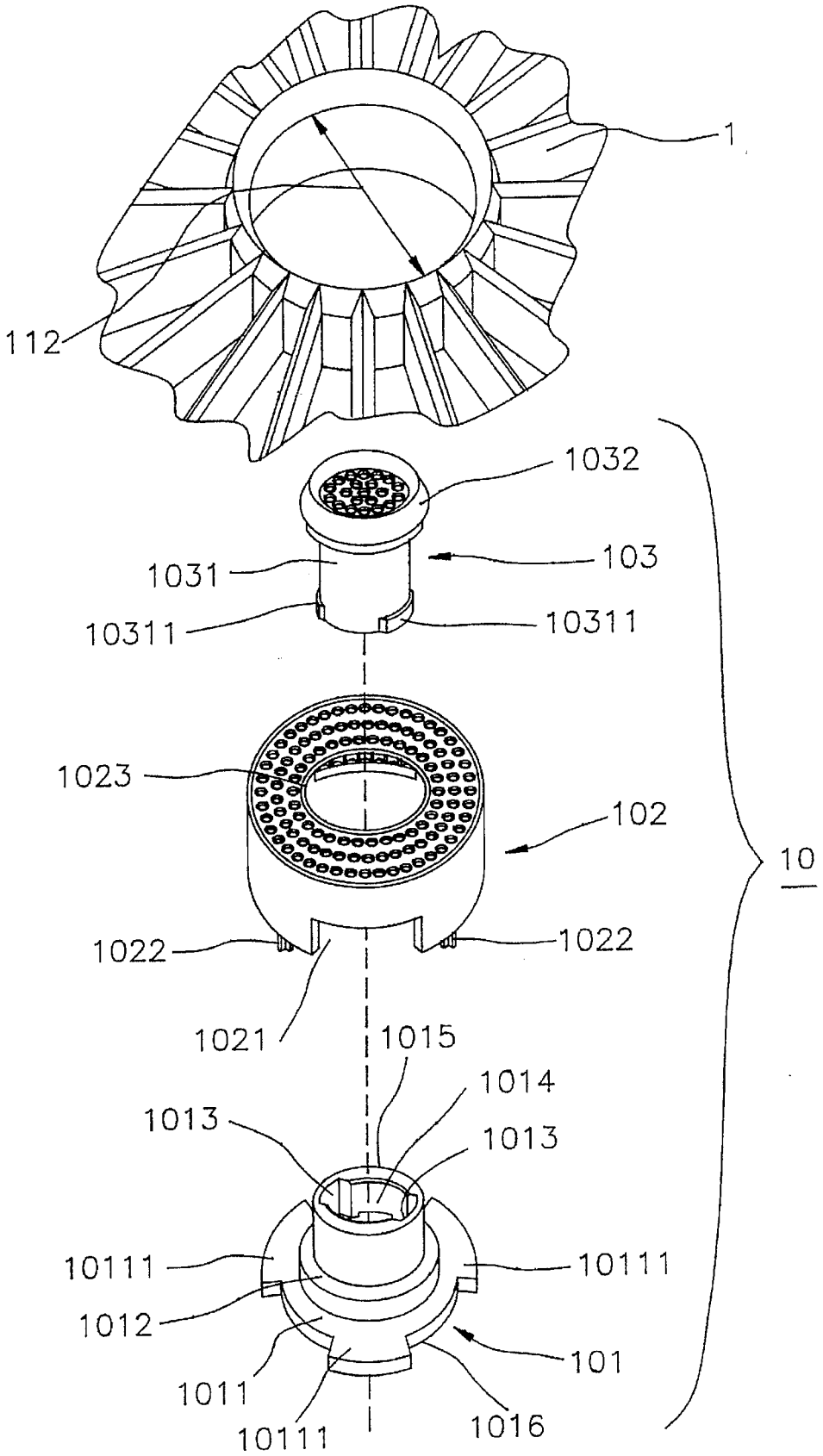
FIG. 4 is an exploded view showing a double bull's-eye device of another preferred embodiment according to the present invention.

Referring to FIG. 4, another preferred embodiment of a double bull's-eye device 10 according to the present invention is similar to the previous preferred embodiment except that the base 101 is not provided with holes 10112 and the three feet 1022 of the outer bull's-eye 102 respectively project through the intermediate recesses formed by every adjacent two of the projecting parts 10111 of the base 101.

To sum up, the present invention provides a new double bull's-eye device which is adapted to be secured within a dart device without screws and can accordingly save the cost spent on the assembling procedure.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A double bull's-eye device adapted to be incorporated within a circular rib formed on a dart frame, comprising:

a base having a top end and a bottom end engageable with the circular rib, and said base being independent of said circular rib;

an outer bull's-eye independent of said base and sleeved from an outer surface of said top end on said base; and an inner bull's-eye independent of said base, passing from said top end through said base to be mounted on said base and separated from said outer bull's eye by said base.

2. A double bull's-eye device according to claim 1, wherein said base is a tubular member provided with at least one inner axial groove and at least one inner circumferential indentation, and including an intermediate shoulder and a bottom flange having a plurality of projecting parts.

3. A double bull's-eye device according to claim 2, wherein said bottom flange has three said projecting parts.

4. A double bull's-eye device according to claim 2, wherein said base has two inner axial grooves and two inner circumferential indentations.

5. A double bull's-eye device according to claim 2, wherein said outer bull's-eye has an annular wall having a plurality of axial indentations for respectively receiving therein said plurality of projecting parts and a plurality of feet for respectively projecting through a plurality of intermediate recesses formed by every adjacent two of said projecting parts of said base.

6. A double bull's-eye device according to claim 2, wherein said plurality of projecting parts respectively have a plurality of through holes.

7. A double bull's-eye device according to claim 6, wherein said outer bull's-eye has an annular wall having a plurality of axial indentations for respectively receiving therein said plurality of projecting parts and a plurality of feet for respectively passing through said plurality of through holes.

8. A double bull's-eye device according to claim 7, wherein said inner bull's-eye further includes:

a hollow cylinder having a top end and at least one bottom projection for being inserted along said at least one inner axial groove and then to be retained respectively in said at least one inner circumferential indentation; and a ring provided on said top end of said hollow cylinder and protruding above said outer bull's-eye.

9. A double bull's-eye device according to claim 1 wherein said inner bull's-eye is independent of said base such that said inner bull's-eye is axially shiftable with respect to said base within a limit defined by said base.

10. A double bull's-eye device according to claim 9 wherein said outer bull's-eye is independent of said base such that said outer bull's eye is axially shiftable with respect to said base within a limit defined by said base.

11. A double bull's-eye device according to claim 1 wherein said outer bull's-eye is independent of said base such that said outer bull's eye is axially shiftable with respect to said base within a limit defined by said base.

12. A dart board apparatus, comprising:

a dart frame having a circular rib;

a base having a top end and a bottom end, said base being engageable with said circular rib, and said base being independent of said circular rib;

an outer bull's-eye sleeved from an outer surface of said base and directly engageable with said circular rib so as to be axially retained in position by said circular rib; and an inner bull's eye passing from said top end through said base so as to be mounted on said base and separated from said outer bull's eye by said base.

13. An apparatus as recited in claim 12 wherein said base has a bottom flange which includes a plurality of projecting parts and said circular rib has a plurality of indentations for respectively engaging with said plurality of projecting parts.

14. An apparatus as recited in claim 12 wherein said outer bull's-eye is axially shiftable between first and second limits defined by said base and circular rib.

15. An apparatus as recited in claim 14 wherein said inner bull's-eye is axially shiftable with respect to said base and limited in axial movement by said base.

16. An apparatus as recited in claim 12 wherein said inner bull's-eye is axially shiftable with respect to said base and limited in axial movement by said base.

17. A double bull's-eye device adapted to be incorporated within a circular rib formed on a dart frame, comprising:

a base having a top end and a bottom end engagable with the circular rib, and said base being independent of said circular rib;

an outer bull's-eye sleeved from an outer surface of said top end on said base; and an inner bull's-eye passing from said top end through said base to be mounted on said base, and said inner bull's eye being separated from said outer bull's eye by said base, and wherein said base is a tubular member provided with at least one inner axial groove and at least one inner circumferential indentation, and including an intermediate shoulder and a bottom flange having a plurality of projecting parts.

18. A double bull's-eye device adapted to be incorporated within a circular rib formed on a dart frame of an electronic scoring dart board, comprising:

a base having a top end and a bottom end with said base being dimensioned for engagement with the circular rib, and said base being independent of said circular rib;

an outer bull's-eye sleeved from an outer surface of said top end on said base; and an inner bull's-eye passing from said top end through said base to be mounted on said base, and said inner bull's-eye, for electronic scoring purposes, being axially shiftable with respect to said base within a limit defined by said base, and said inner bull's eye being separated from said outer bull's eye by said base.

19. A double bull's-eye device according to claim 18 wherein said outer bull's-eye is sleeved on said base such that said outer bull's-eye, for electronic scoring purposes, is axially shiftable with respect to said base within a limit defined by said base and the circular rib.

20. A dart game apparatus, comprising:

a dart board frame having a circular rib;

a base having a top end and a bottom end, said base being detachably engaged with said circular rib;

an outer bull's-eye slideably received by said base and directly engageable with said circular rib so as to be axially retained in position by said circular rib; and an inner bull's eye passing from said top end through said base so as to be slideably received by said base.

* * * * *